US009754441B1

(12) United States Patent
Curtis et al.

(10) Patent No.: US 9,754,441 B1
(45) Date of Patent: Sep. 5, 2017

(54) GAME SYSTEMS AND RELATED METHODS

(71) Applicant: Parkside Games LLC, Phoenix, AZ (US)

(72) Inventors: Derek Curtis, Peoria, AZ (US); Tim Uzzanti, Scottsdale, AZ (US); Grady Werner, Phoenix, AZ (US); Bryon Grosz, Scottsdale, AZ (US)

(73) Assignee: Parkside Games LLC, Phoenix, AZ (US)

( * ) Notice: Subject to any disclaimer, the term of this patent is extended or adjusted under 35 U.S.C. 154(b) by 98 days.

(21) Appl. No.: 15/043,488

(22) Filed: Feb. 12, 2016

Related U.S. Application Data

(60) Provisional application No. 62/115,444, filed on Feb. 12, 2015, provisional application No. 62/143,281, filed on Apr. 6, 2015.

(51) Int. Cl.
*A63F 9/24* (2006.01)
*G07F 17/32* (2006.01)

(52) U.S. Cl.
CPC ..... *G07F 17/3209* (2013.01); *G07F 17/3218* (2013.01); *G07F 17/3223* (2013.01); *G07F 17/3255* (2013.01)

(58) Field of Classification Search
None
See application file for complete search history.

(56) References Cited

U.S. PATENT DOCUMENTS

2002/0072410 A1* 6/2002 Tanaka ..... A63F 13/02 463/37
2011/0086693 A1* 4/2011 Guziel ..... G07F 17/32 463/17
2013/0065687 A1* 3/2013 Sakai ..... A63F 13/577 463/37
2014/0121003 A1* 5/2014 Mueller ..... A63F 13/12 463/25

* cited by examiner

*Primary Examiner* — Paul A D'Agostino
(74) *Attorney, Agent, or Firm* — Law Office of Paul B. Johnson

(57) ABSTRACT

A game system includes a server coupled with a database and an operator computer. The operator computer receives input from an operator to associate, through the database, a prize identifier and a winning tap number for a prize. A plurality of player devices coupled with the server through a telecommunication network display player interfaces including the prize identifier, winning tap number, and a defined tapping area. Each player device, in response to a tap in the defined tapping area, communicates a tap signal to the server. The server generates an assigned tap number for each tap signal. In response to determining that an assigned tap number matches the winning tap number, the server sends a winning signal to the sending device. The game system provides an advertising platform through sponsored prizes and paid advertising viewed by players to enable players to continue tapping for sponsored prizes.

20 Claims, 6 Drawing Sheets

GAME SYSTEMS AND RELATED METHODS

CROSS REFERENCE TO RELATED APPLICATIONS

This document claims the benefit of the filing date of U.S. Provisional Patent Application No. 62/115,444, entitled "Game System and Related Methods," listing as first inventor Derek Curtis, which was filed on Feb. 12, 2015, and U.S. Provisional Patent Application No. 62/143,281, entitled "Game System and Related Methods," listing as first inventor Derek Curtis, which was filed on Apr. 6, 2015, the disclosure of each of which is hereby incorporated entirely herein by reference.

BACKGROUND

1. Technical Field

Aspects of this document relate generally to software applications (apps) for mobile computing devices. Specific aspects relate to game software applications played on touchscreen mobile computing devices to win prizes.

2. Background

A number of software applications (apps) exist for mobile computing devices. Some applications include game elements. Some applications include gambling or contest elements. Software applications operated on mobile devices may be implemented using one or more servers remote from the mobile devices.

SUMMARY

Implementations of game systems may include: a server operatively coupled with a database; an operator computer operatively coupled with the server, the operator computer having a display displaying one or more operator user interfaces, the one or more operator user interfaces configured to receive one or more inputs from an operator to associate, through the database, a prize identifier and a winning tap number for a prize; a plurality of mobile computing devices (player devices) operatively coupled with the server through a telecommunication network, each player device displaying, on a touchscreen display, a player user interface (player interface) including the prize identifier, the winning tap number, and a defined tapping area; wherein each player device is configured to, in response to receiving a tap within the defined tapping area, communicate a tap signal to the server through the telecommunication network, the tap signal including an identifier of a user (sending user) and/or an identifier of the player device sending the tap signal (sending device); wherein the server is configured to, in response to receiving the tap signal, generate an assigned tap number for the tap signal and associate, in the database, the assigned tap number with the sending user and/or the sending device; wherein the server is configured to determine whether the assigned tap number matches the winning tap number; wherein the server is configured to, in response to determining that the assigned tap number matches the winning tap number, send a winning signal to the sending device through the telecommunication network, and; wherein the sending device is configured to display a winning indicator on the player interface in response to receiving the winning signal, the winning indicator indicating that the sending user has won the prize.

Implementations of game systems may include one, all, or any of the following:

The defined tapping area of each player device may have a default wait time of over two seconds between taps, and each player device may be configured to, in response to receiving a tap within the defined tapping area during the default wait time, not communicate a tap signal to the server.

The player interface may further include a boost indicator, the boost indicator configured to, in response to receiving a touch input from a user, do one or more of the following: shorten the default wait time; increase a quantity of tap signals sent to the server in response to receiving a tap within the defined tapping area; modify tap signals for a predetermined amount of time such that the server generates a plurality of consecutive assigned tap numbers for each modified tap signal, and; automatically send a plurality of tap signals to the server without receiving a tap within the defined tapping area.

The server may generate the assigned tap number based upon a time that the tap signal was received at the server and/or a time that the tap signal was sent from the sending device.

The one or more operator user interfaces may be further configured to receive one or more inputs from the operator to define a plurality of milestone tap numbers lower than the winning tap number, and the server may be configured to, when the assigned tap number matches one of the milestone tap numbers, send a milestone signal to the sending device through the telecommunication network, and the sending device may be configured to display a milestone won indicator on the player interface in response to receiving the milestone signal, the milestone won indicator indicating that the sending user has won a milestone prize.

The prize identifier may include an image of the prize and/or a written description of the prize.

The server may be configured to send a tap number signal to the sending device through the telecommunication network in response to generating the assigned tap number, and the sending device may be configured to display the assigned tap number on the player interface in response to receiving the tap number signal.

Implementations of game systems may include: a server operatively coupled with a database; an operator computer operatively coupled with the server, the operator computer having a display displaying one or more operator user interfaces, the one or more operator user interfaces configured to receive one or more inputs from an operator to associate, through the database, a prize identifier and a winning tap number for each of a plurality of prizes; a plurality of mobile computing devices (player devices) operatively coupled with the server through a telecommunication network, each player device displaying, on a touchscreen display, a plurality of player user interfaces (player interfaces), wherein each player device is configured to, in response to receiving a touch input from a user, switch between the plurality of player interfaces; wherein each player interface includes a defined tapping area, the prize identifier associated with one of the prizes, and the winning tap number associated with that prize; wherein each player device is configured to, in response to receiving a tap within the defined tapping area of one of the player interfaces associated with one of the prizes (played prize), communicate a tap signal to the server through the telecommunication network, the tap signal including an indicator of the played prize and further including an identifier of a user (sending user) and/or an identifier of the player device sending the tap signal (sending device); wherein the server is configured to, in response to receiving the tap signal, generate an assigned tap number for the tap signal and associate, in the database, the assigned tap number with the played prize and with the sending user and/or the sending device; wherein the server is configured to determine whether the assigned tap number matches the winning tap number for the played prize; wherein the server is configured to, in response to determining that the assigned tap number matches the winning tap number for the played prize, send a winning signal to the sending device, and; wherein the sending device is configured to display a winning indicator on one of the player interfaces in response to receiving the winning signal, the winning indicator indicating that the sending user has won the played prize.

Implementations of game systems may include one, all, or any of the following:

The defined tapping area of each player interface may have a default wait time of over two seconds between taps, and each player device may be configured to, in response to receiving a tap within the defined tapping area during the default wait time, not communicate a tap signal to the server.

Each player interface may further include a boost indicator, the boost indicator configured to, in response to receiving a touch input from a user, do one or more of the following: shorten the default wait time; increase a quantity of tap signals sent to the server in response to receiving a tap within the defined tapping area; modify tap signals for a predetermined amount of time such that the server generates a plurality of consecutive assigned tap numbers for each modified tap signal, and; automatically send a plurality of tap signals to the server without receiving a tap within the defined tapping area.

The server may generate the assigned tap number based upon a time that the tap signal was received at the server and/or a time that the tap signal was sent from the sending device.

The one or more operator user interfaces may be further configured to receive one or more inputs from the operator to define a plurality of milestone tap numbers lower than the winning tap number for each prize, and the server may be configured to, when the assigned tap number matches one of the milestone tap numbers for the played prize, send a milestone signal to the sending device through the telecommunication network, and the sending device may be configured to display a milestone won indicator on one of the player interfaces in response to receiving the milestone signal, the milestone won indicator indicating that the sending user has won a milestone prize.

The server may be configured to send a tap number signal to the sending device through the telecommunication network in response to generating the assigned tap number, and the sending device may be configured to display the assigned tap number on one of the player interfaces in response to receiving the tap number signal.

Implementations of methods of playing a tapping game may include: operatively coupling a server with a database; operatively coupling an operator computer with the server; receiving at the operator computer, using one or more operator user interfaces displayed on a display of the operator computer, one or more inputs from an operator to associate, through the database, a prize identifier and a winning tap number for a prize; operatively coupling a plurality of mobile computing devices (player devices) with the server through a telecommunication network; displaying, on each player device, on a touchscreen display, a player user interface (player interface) including the prize identifier, the winning tap number, and a defined tapping area; receiving, at each player device, a tap within the defined tapping area of the player interface; communicating a tap signal to the server through the telecommunication network from each player device, each tap signal including an identifier of a user (sending user) and/or an identifier of the player device sending the tap signal (sending device); generating, through the server, in response to receiving each tap signal, an assigned tap number; associating, through the database, the assigned tap number with the sending user and/or the sending device; determining, using the server and/or the operator computer, whether the assigned tap number matches the winning tap number; in response to determining that the assigned tap number matches the winning tap number, sending, using the server and/or the operator computer, through the telecommunication network, a winning signal to the sending device, and; displaying, on the player interface of the sending device, in response to receiving the winning signal, a winning indicator, the winning indicator indicating that the sending user has won the prize.

Implementations of methods of playing a tapping game may include one, all, or any of the following:

The defined tapping area of each player device may have a default wait time of over two seconds between taps, and each player device, in response to receiving a tap within the defined tapping area during the default wait time, may not communicate a tap signal to the server.

The player interface may further include a boost indicator, and the boost indicator, in response to receiving a touch input from a user, may do one or more of the following: shorten the default wait time; increase a quantity of tap signals sent to the server in response to receiving a tap within the defined tapping area; modify tap signals for a predetermined amount of time such that the server generates a plurality of consecutive assigned tap numbers for each modified tap signal, and; automatically send a plurality of tap signals to the server without receiving a tap within the defined tapping area.

The method may further include using the player interface as an advertising platform by providing the prize identifier, an identifier for a sponsor of the prize, and access to paid advertisements viewable by players through the player interface to enable the players to continue tapping for the prize.

The method may further include receiving one or more inputs from the operator through the one or more operator user interfaces to define a plurality of milestone tap numbers lower than the winning tap number, and the server, in response to determining that the assigned tap number matches one of the milestone tap numbers, may send a milestone signal to the sending device through the telecommunication network, and the sending device may display a milestone won indicator on the player interface in response to receiving the milestone signal, the milestone won indicator indicating that the sending user has won a milestone prize.

The winning tap number may be displayed on the player interface of each player device only after a tap has been received within the defined tapping area of that player interface.

The method may include sending, using the server and/or the operator computer, in response to generating the assigned tap number, a tap number signal to the sending device through the telecommunication network, and displaying the assigned tap number on the player interface of the sending device in response to the sending device receiving the tap number signal.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended game systems and related methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such game systems and related methods, and implementing components and methods, consistent with the intended operation and methods.

Figure 1:
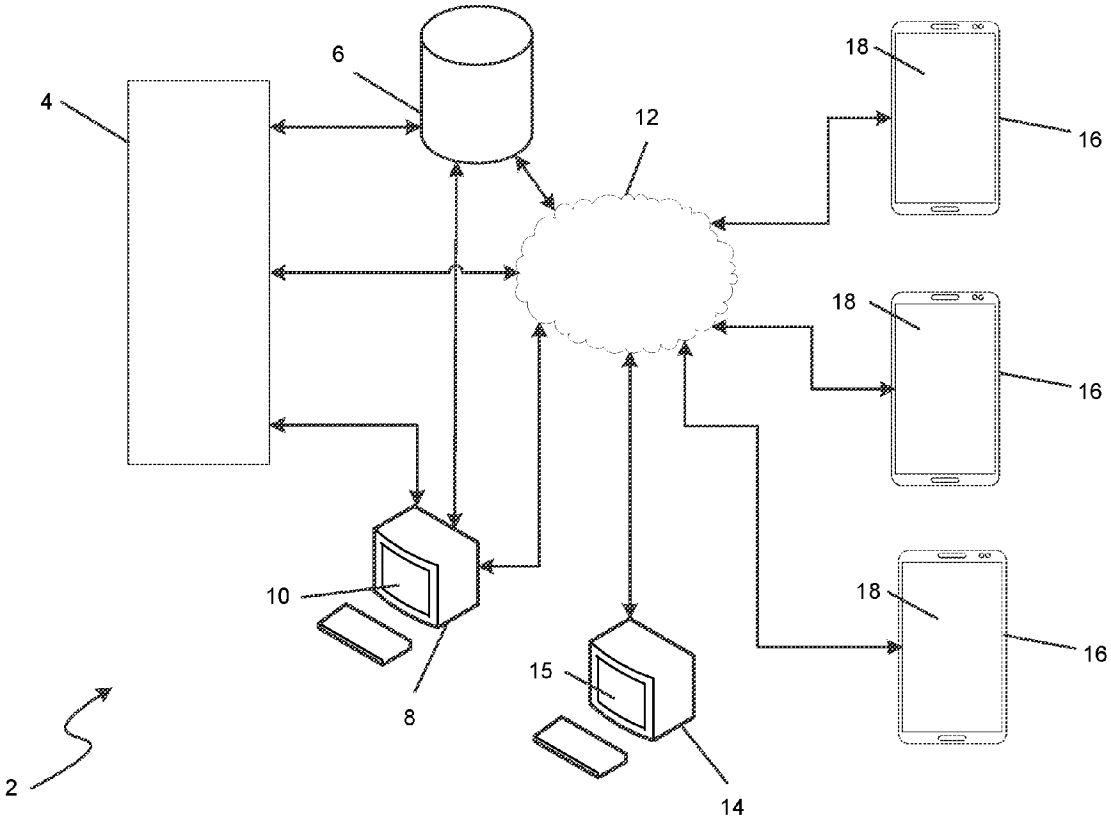
FIG. 1 is a block diagram illustrating an implementation of a game system.

Referring now to FIG. 1, in implementations a game system 2 includes a server 4 operatively coupled with a database 6. An operator computer 8 is operatively coupled with the server and includes a display 10 on which one or more user interfaces may be displayed. A plurality of mobile computing devices (player devices) 16 are operatively coupled with the server through a telecommunication network 12, which may be the Internet. Each player device includes a touchscreen display 18. A sponsor/funder computer 14 may also be operatively coupled with the server and/or with the operator computer through the telecommunication network and may include a display 15 on which one or more sponsor/funder user interfaces may be displayed.

The connecting arrows in FIG. 1 show that there may be multiple or various couplings between elements. For example the operator computer may be operatively coupled directly with the database such as through a wired network or through the telecommunication network. The operator computer may be operatively coupled directly with the server or through the telecommunication network. The sponsor/funder computer may be coupled through the telecommunication network with any of the operator computer, the server, the database, and the player devices. The player devices may be operatively coupled with the sponsor/funder computer, the operator computer, the server, one or more other player devices, and/or the database through the telecommunication network.

Although the various components of FIG. 1 are shown as discrete, separate elements, in implementations they may be combined with other elements. Accordingly, the operator computer, server, and/or database could be combined on a single machine, or could be implemented on a single machine using virtual servers, or could be implemented using different machines. In implementations the sponsor/funder computer could be excluded. The operator computer could be a desktop computer, a laptop, a mobile device such as a tablet or smart phone, and the like. The server and/or database could be implemented using a cloud server and may be coupled with the operator computer only through the telecommunication network. The sponsor/funder computer could be a desktop computer, a laptop, a mobile device such as a tablet or smart phone, and the like.

Additional components could be included in a game system such as a database server, a web server to provide a web interface for players, a server for handling payments from players, a cache server, and so forth. Any type of database and/or database server could be used to implement the game system. By non-limiting example, in implementations the database may be implemented using a database server and/or the server 4 and may include one or more database software formats marketed under the tradenames ORACLE by Oracle Corporation of Redwood Shores, Calif.; IBM DB2 by International Business Machines Corporation (IBM) of Armonk, N.Y.; MYSQL by Oracle Corporation; INFORMIX by IBM; MICROSOFT SQL SERVER by Microsoft Corporation of Redmond, Wash., INGRES by Actian Corporation of Redwood City, Calif.; and the like.

Referring still to FIG. 1, through one or more operator user interfaces displayed on the display 10 of the operator computer an operator may input one or more inputs through which parameters and/or details of a game are defined. An operator may, for instance, decide on a prize to be won through the game and may upload or select an image or wording representative of the prize, to be used as a prize identifier 34 (discussed hereafter). An operator may additionally select a winning tap number 63 (described hereafter) to determine which "tap" will win the prize (such as the 100th tap, the 1,000th tap, the 15,000th tap, and so forth).

The specific outlay and design of the of the one or more operator user interfaces are not shown in the drawings but many configurations are possible and are well within the knowledge of the practitioner of ordinary skill in the art such that they are not needed in order to enable the game systems and related methods disclosed herein. Such operator user interfaces may include one or more fields to receive inputs from an operator, such as to receive a prize identifier, a prize image, a prize written description, a prize sponsor identifier (sponsor identifier), prize sponsor contact information, one or more links to a sponsor website, one or more links to a shopping site selling a prize, a winning tap number, milestone tap numbers, a desired advertisement time, a desired advertisement level, and so forth. User interfaces for sponsor/funder computers may contain similar or the same fields and, again, are not shown in the drawings but many configurations are possible and are well within the knowledge of the practitioner of ordinary skill in the art.

While the operator could manually input a winning tap number, alternatively, the operator may input some other information, such as an amount of advertising time, or an advertising level, and an algorithm implemented using the operator computer and/or server may determine the winning tap number. When the game is played the prize identifier will be displayed on touchscreen displays of player devices and, accordingly, provides some advertising time. The algorithm may determine, for example, based on an average time per tap, average number of players per promotion, and so forth, how much advertising time will be implemented using any given number of taps and, accordingly, may select an appropriate winning tap number to provide the correct amount of advertising time to the sponsor/funder.

The operator may thus set up the parameters of a game. A sponsor/funder may communicate with an operator to provide details of a sponsored game. For example a sponsor/funder could communicate with the operator through telephone or in person and the operator could then input details related to a game, such as inputting one or more inputs on one or more user interfaces of the operator computer to define a prize identifier and a winning tap number associated with a prize and to associate these, through the database, with one another. These may also be associated with a sponsor identifier through the database.

In other implementations the sponsor/funder could input some of the above information through a sponsor/funder computer coupled with the elements through a telecommunication network as shown in FIG. 1. For example, using a desktop computer, laptop mobile device such as a smartphone or the like, a sponsor/funder could, through one or more user interfaces displayed on display 15, input one or more inputs to define a prize identifier and a winning tap number and to associate these, through the database, with one another and with a prize. These may also be associated with a sponsor identifier through the database. The winning tap number, as indicated above, may be selected by the sponsor/funder or may be determined by an algorithm based on one or more inputs of the sponsor, as described above with respect to the operator.

Any number of sponsors may sponsor prizes. Accordingly, although only one sponsor/funder computer is shown in FIG. 1, there may be many coupled with the server and/or database and/or operator computer at any given time through the telecommunication network. Each sponsor may have an account, with login credentials and the like being stored in the database and may allow each sponsor to input one or more inputs through user interfaces on displays 15 to define parameters of one or more games.

There may further be advertiser computers coupled with the server, operator computer, and/or database through the telecommunication network. Advertisers may purchase advertising space to be implemented during a game independent of sponsorship or funding of a game. For example, players may watch video advertisements in a game to earn spins on a prize wheel during a game, which will be described hereafter, and the advertisers providing such video advertisements may purchase advertising time/space to show such videos without otherwise offering sponsored prizes. Such advertisement videos and the like may be stored on one or more advertiser servers coupled with the player devices through the telecommunication network (and such advertiser servers may be owned/operated by the advertiser(s)), or may be stored on the server, the operator computer, or the database.

A sponsored prize is a prize that a sponsor/funder offers to be won by a winning tap. In exchange for offering the prize to players the sponsor/funder receives some advertising and promotion time, as discussed to some extent above, inasmuch as the players view the prize identifier while tapping to win the prize. As a non-limiting example, referring to FIGS. 2-3, a player user interface (player interface) 20 displayed on touchscreen displays 18 of player devices is shown. A prize display area 32 includes one or more prize identifiers 34, including an image 40 of the prize 36 and a written description 42 of the prize. In the representative example the prize is a new tablet. The prize display area could also include a sponsor identifier, which in this case could be the manufacturer or seller of the type of tablet that is being offered as a prize. For example, the sponsor identifier could include the name of the manufacturer or seller, the brand or family name of the manufacturer, seller, product or product line, the logo of the manufacturer, seller, or product or product line, etc.

Figure 2:
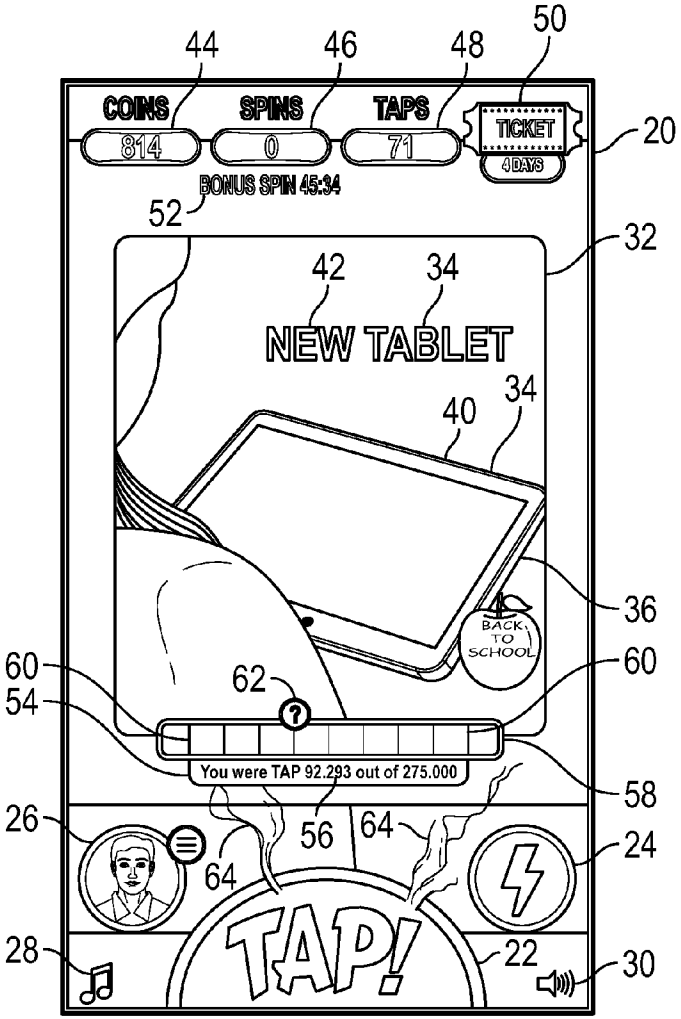
FIG. 2 is a first representation of a first player interface of a game played using the game system of FIG. 1.
Figure 3:
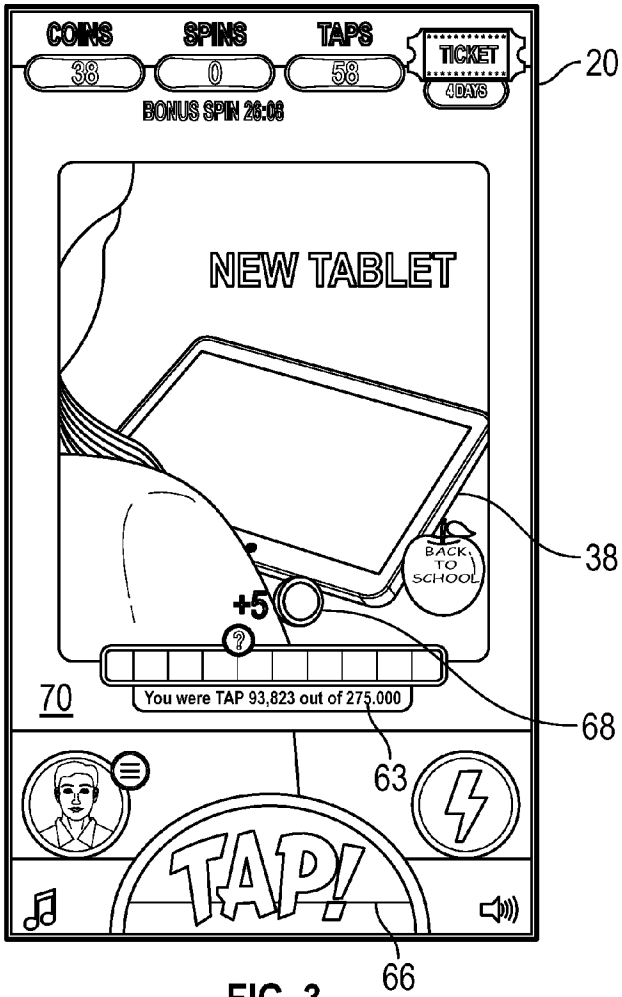
FIG. 3 is a second representation of the first player interface of the game of FIG. 2.

In the implementation shown in FIGS. 2-3 the operator and/or sponsor has already input one or more inputs through one or more user interfaces to define the winning tap number, and the winning tap number 63 is shown to be 275,000 taps. Accordingly, the player that executes the 275,000th tap will win the prize. The player interface includes a defined tapping area 22. When a player is on the player interface 20 and taps the touchscreen display within the defined tapping area, a "tap" is executed and the player device, in response, sends a tap signal to the server through the telecommunication network.

The tap signal may include an identifier of a user (sending user). For example, the user who executed the tap may have a user account (player account), with login credentials stored in the database, and the player device on which the tap was executed may thus include in the tap signal an identifier associated with the logged-in user. The tap signal may additionally or alternatively include an identifier of the player device sending the tap signal (sending device). A cookie may be stored on the player device and this may be used to identify the player device and/or the user. A player account may be associated with a player's email address or, in implementations, may be associated with one or more social media accounts of the player through the database.

In response to receiving the tap signal, the server generates an assigned tap number. This assigned tap number is associated with the sending user and/or the sending device through the database, and after generating the assigned tap number the server communicates a tap number signal to the sending device, the tap number signal including the assigned tap number. In response to receiving the tap number signal, the sending device displays the assigned tap number 56 as shown in FIGS. 2-3. In the implementation shown the assigned tap number is displayed on a tap count indicator 54 which displays language such as "You were TAP 93,823 out of 275,000," and thus the tap count indicator displays both the assigned tap number and the winning tap number.

However, in implementations the winning tap number is not displayed on the tap count indicator until the player executes a first tap for that prize. This is user specific. In other words, a first user may execute a tap on a first player device for a first prize, and may then see the winning tap number displayed (along with the assigned tap number). For a second user, however, using a second player device, the winning tap number will not be displayed until the second user also executes a first tap (the second user's first tap) for the first prize.

In the implementation shown the tap count indicator displays the assigned tap number for the last tap executed by a player and only updates when a new tap is executed. Thus, in FIG. 2 the assigned tap number is shown to be "92,293" while in FIG. 3 the assigned tap number is shown to be "93,823." Accordingly, between the player's last two taps there were a total of 1,530 other taps executed by other players using other player devices. In order to find out how close he/she is to the winning tap number, a player accordingly needs to execute a tap to find his/her latest assigned tap number. Executing a tap, accordingly, provides an information-gathering function to determine how close the player is to winning the prize.

A prize for which the user has tapped is a played prize 38. As indicated above, there may be many players playing for the prize simultaneously, each tapping on a defined tap interface of a different player device. Accordingly, the server generates assigned tap numbers to each received tap signal, received from different player devices, and sends tap number signals to the player devices, accordingly, to update each player as to his/her last assigned tap number.

The server determines whether/when an assigned tap number matches the winning tap number and, when this is the case, sends a winning signal to the sending device (that sent the winning tap signal) through the telecommunication network. The sending device, in response to receiving the winning signal, displays a winning indicator on one or more user interfaces of the sending device (which may be the player interface 20 associated with the played prize 38). The winning indicator may include a link to be followed by the player to claim the prize and/or to input information (such as contact or mailing information) to obtain or receive the prize. The winning indicator may directly include such information or input fields instead of providing them through a redirecting link. The winning indicator could alternatively provide sponsor contact information or a link to the sponsor's website, and may include a prize code or the like, to obtain the prize.

In addition to the winning tap signal, the operator and/or sponsor/funder may provide one or more inputs, such as through one or more user interfaces displayed on display 10 or display 15, to define one or more milestone tap numbers smaller than the winning tap number. The milestone tap numbers may be chosen or defined in increments. For example in FIGS. 2-3 the winning tap number is 275,000 taps and there are nine milestones 60, each indicated by a vertical line on a milestone indicator 58, each milestone associated with one of the milestone tap numbers. Thus, each milestone may be at an increment of 27,500 taps. In implementations the milestone tap numbers could be specifically selected by an operator or sponsor/funder, but in the implementation shown in the drawings the milestones are selected by an algorithm at 10% increments of the winning tap number.

The server determines whether an assigned tap number matches one of the milestone tap numbers. In the example above there are nine milestone tap numbers in addition to the winning tap number. Upon determining that an assigned tap number matches one of the milestone tap numbers for a played prize, the server sends a milestone signal to the sending device (that sent the tap signal) and the sending device, in response to receiving the milestone signal, displays a milestone won indicator indicating to the sending user that the sending user has won a milestone prize.

In the tapping game implementation shown in the drawings the milestone prizes are in-game prizes that are not offered by sponsors/funders but are offered by the operator or game host. For example, prizes may include a certain number of taps, a certain number of coins, a certain number of spins, one or more boosts, one or more raffle tickets, a gift card, or the like, each of which will be described in more detail hereafter. In other implementations milestone prizes could be prizes offered by sponsors/funders, either the same sponsor/funder offering the prize for the winning tap number or one or more other sponsors/funders.

Referring back to FIGS. 2-3, a next milestone indicator 62 is shown, which in the implementation shown has the logo of a question mark. A player may tap on the next milestone indicator to display player interface 148 shown in FIG. 11. Player interface 148 shows a vertically scrollable (through a user swiping) display which displays each milestone tap number 152 and, for those that have already been reached, the milestone winner 150 and the milestone prize 154. As FIG. 11 shows, in one example the milestones were in increments of 500 taps and at tap 2,000 a player named "user4" won a prize, "user3" executed tap 2,500 and won 10 spins on a prize wheel, "user2" executed tap 3,000 and won 1,000 coins, "user1" executed tap 3,500 and won 15 tickets for a raffle, and the 4,000th tap has not yet been executed.

Figure 11:
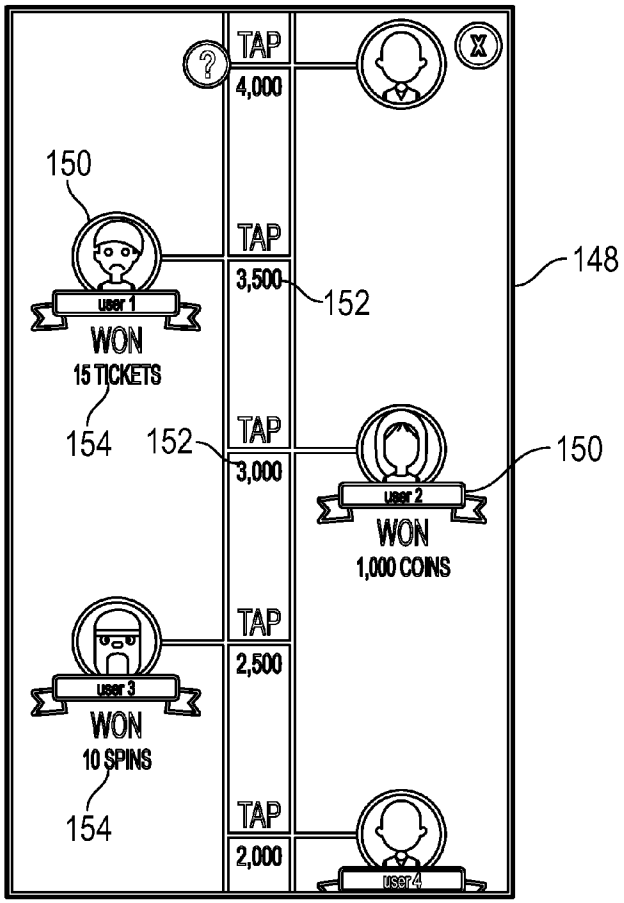
FIG. 11 is an eighth player interface of the game of FIG. 2.

FIG. 11 shows player avatar images and user names. Each player may have an avatar image and user name associated with his/her user profile/account. From FIGS. 2-3 it may be seen that there is a profile indicator 26 displayed on player interface 20. The profile indicator may include a number proximate it to indicate how many unread messages a player has. The profile indicator displays the player's selected avatar. When a player taps the profile indicator a Profile Interface is displayed. The Profile Interface includes an "X" to return to the previous interface. The Profile Interface includes an image of the player avatar and the player's selected name. The game system is configured to assign a default name to each player that the player may later change.

On the Profile Interface the player may tap on the avatar image to bring up a list of selectable avatars. Each avatar may have an avatar name and some avatars may be free while some may cost a certain number of in-game "coins." A player may accordingly select either a free avatar or may purchase an avatar with in-game coins and, once selected, this avatar will be displayed for the player. Avatars may have different looks, such as different hair color, different clothing, glasses or no glasses, male or female, etc.

The Profile Interface further includes a "My Information" button. A user may tap on this button and bring up a My Information interface. This interface includes an "X" which a user may tap to return to the previous interface. The player's avatar is displayed, which may be tapped to bring up the list of selectable avatars as previously described. The player name is displayed and may be tapped to bring up an edit screen where the player may edit his/her user name. A zip code is displayed which may be tapped to bring up an edit screen where the player may edit his/her zip code. The zip codes of players may be optional and may be used for geographically targeted advertisements. The user's email address is displayed which may be tapped to bring up an edit screen where the email may be edited.

A notifications button is also visible on the My Information interface, this may be tapped by a user to toggle between an ON and an OFF state, to turn game notifications on or off, as desired. A tutorial button ON/OFF button is also displayed which may be tapped to turn tutorial elements on or off. On the My Information interface there is also a link to the Official Rules, a link to Terms of Service, and a link to the Privacy Policy. A "Load Last Play" button is also shown, which may be tapped to load the last game state associated with the user's account (associated with the user's email address through the database)—allowing a user to play the game on multiple different devices at the same time, using the same number of taps, coins, spins, etc. associated with the user account)—loading this data may overwrite previous game data on the player device. A Contact Support button is also visible, which may be tapped to open a website providing contact information for the operator and/or various other items of information to resolve game issues.

From the Profile Interface a My Invites button is visible. A player may tap this and bring up a My Invites interface, which allows the player to invite another person to play the game. This may involve prizes, by non-limiting example, for thirty days after an invite code is entered by the friend. For the thirty day period, for example, if the friend wins a prize (including a raffle drawing and excluding milestone, TapOff and flash prizes) then the friend and the original player may each win a $10 gift card. The original player may also earn 1 spin for every 10 spins earned by the friend for the first 30 days (including spins won from milestones, raffle drawings, TapOffs, and flash prizes). The original player may also earn 1 raffle ticket for every 5 raffle tickets earned by the friend for the first 30 days (including tickets won from milestones, raffle drawings, TapOffs and flash prizes). The prizes available during the 30 day period may exclude private games. The friend, upon installing the game software on his/her player device or upon receiving the code, may come to this screen to enter a code received from the original player to activate the promotion. Prizes that are "flash" prizes may be identified as such with the wording "flash" next to the prize display area. By non-limiting examples, a prize of 100 raffle tickets and a prize of 50 spins may each be a flash prize, while a prize of 500 spins may not be a flash prize.

The Profile Interface includes a messages button which may be tapped by a player to open a messages interface. The messages interface includes messages from the operator, from other players, and/or messages that are automatically sent using the game system. Each message may include a prize for opening the message, such as one or more coins, one or more spins, one or more tickets in a raffle drawing, and the like, and an animation (such as an explosion of raffle tickets, an explosion of coins, etc.) may appear when the message is opened or thereafter along with a sound to indicate the prize.

The Profile Interface includes a Recent Winners button which may be tapped to bring up a Recent Winners list. This list includes categories of Prizes, Drawings, Milestones, TapOffs, and Jackpots, and the player may tap on any of these selections to bring up a list of latest winners of those items, which displays on a vertically scrollable list (through a user swiping) the avatars and user names of the winning players, what was won, and the date each prize was won (in some cases an image 40 of the prize is also displayed and/or a written description 42 of the prize, and in some cases the user avatar is excluded). The images of the prizes may be tapped on by a player to bring up a Prize/Sponsor Interface, which shows a number of scrollable images of the prize, information about the sponsor of the prize (including contact information and links to websites, social media, and the like), a description of the prize, a link to an online retailer offer to purchase the prize (such as an online retail site operated under the trade name AMAZON or AMAZON.COM by Amazon Technologies, Inc. of Reno, Nev.) and (if the prize has already been won) the winning player avatar, user name, and date won. One or more of the scrolling images may be tapped to open a larger version of that image. The Prize/Sponsor Interface may also detail the milestone prizes (for example indicating that there are milestone prizes at every 250 taps).

The Profile Interface further includes a Leaderboards button which may be tapped to bring up a list of leaderboard categories, including Top Tappers, Top Tap Hoarders, Top Coin Spenders, Top Coin Hoarders, Daily 3×3 Puzzle, Daily 4×4 Puzzle, Daily 3 Life Brick Tapper, and Daily 1 Life Brick Tapper. Each of these categories may be tapped to bring up a list of the highest ranked players in each category, which may include player avatars and user names and other information, amount of taps executed, amount of taps hoarded, amount of coins spent, amount of coins hoarded, time to complete a 3×3 puzzle, time to complete a 4×4 puzzle, time to beat a 3 life brick tapper game, or time to beat a 1 life brick tapper game. Some of these listings may be daily listings (such as the Daily 3×3 Puzzle, Daily 4×4 Puzzle, Daily 3 Life Brick Tapper, and Daily 1 Life Brick Tapper) and may accordingly be refreshed each day to only show the leaders for that day. This may incentivize players to play those in-game games daily to achieve a daily spot on the rankings.

The Profile Interface further includes a Private Games button which may be tapped to bring up a Private Game interface. Private games may be offered by a sponsor and may be associated with an invitation code. Everyone with the invitation code may then enter it to enter the Private Game. For example, a Private Game could be offered by a corporation at a company retreat, using an invitation code, and the employees and staff could enter the invitation code on their individual player devices (cell phones, tablets, etc.) to tap for a prize offered by the company/corporation. Private Games are only available to players who have been expressly invited to play a specific private game. However, players who participate in private games can also participate in any public prizes that are available to any other player.

Figure 4:
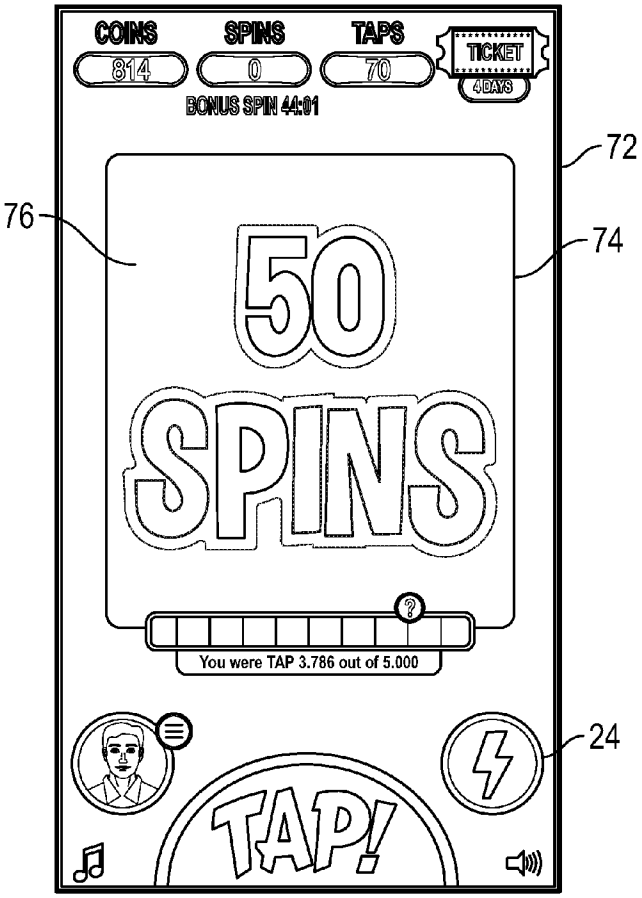
FIG. 4 is first representation of a second player interface of the game of FIG. 2.
Figure 10:
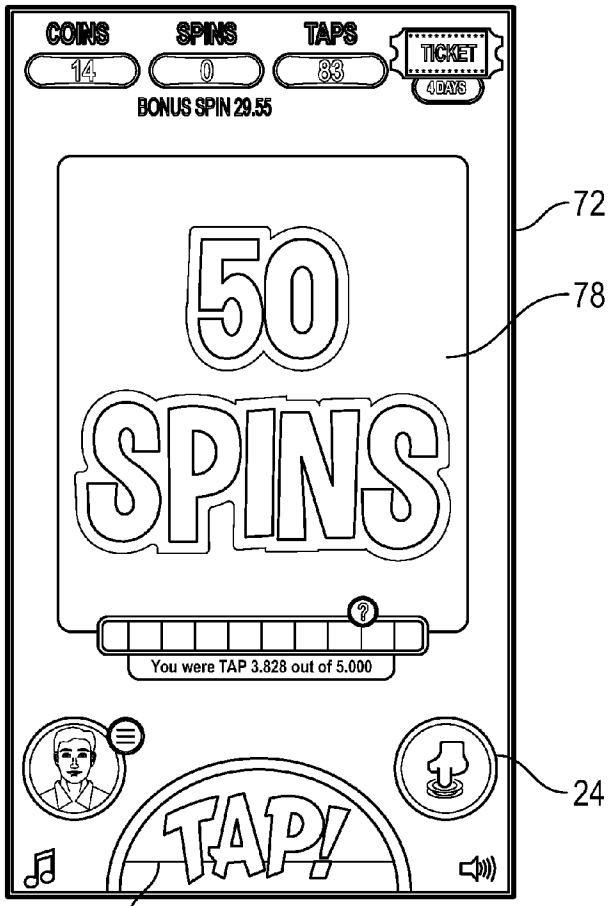
FIG. 10 is a second representation of the second player interface of FIG. 4.

Although prizes may be offered by sponsors/funders, some prizes may be offered by the operator and may include in-game prizes, such as a number of taps, a number of spins of a prize wheel, a number of raffle tickets, and the like. Accordingly, FIGS. 4 and 10 show a player interface 72 for which the prize 76 is 50 spins on a prize wheel. The prize identifier 74 thus includes the wording "50 Spins" and when a tap is executed within the defined tapping area the prize becomes a played prize 78.

A tapping game implemented using the game system 2 may include any number of prizes offered by sponsors and/or the operator. The player interface 20 and player interface 72 may be switched between one another by a player swiping to the side on either player interface 20/72. Similarly there may be other prizes that may be viewed in other player interfaces by swiping to the side. Prizes may include goods or services offered by sponsors/funders and/or in-game prizes offered by the operator. On each player interface, when a user taps the prize display area the Prize/Sponsor Interface may pop up, which was described previously, which a user may "X" out of to return to the previous screen.

Prizes may therefore include, by non-limiting example: a prize of 100 raffle tickets offered by the operator; an external hard drive offered by a sponsor; a quadcopter drone toy offered by a sponsor; a smartphone case offered by a sponsor; one or more video game codes to play a video game online (such as offered under the trade name STEAM by Valve Corporation of Bellevue, Wash.), a prize of 50 spins on a prize wheel offered by the operator; a mobile tablet device offered by a sponsor; a prize of 500 spins on a prize wheel offered by the operator; and so forth.

A TapOff interface may also be accessed in the same way as described above, i.e., a player may scroll to it by swiping to the side between prizes until the TapOff interface is shown. The TapOff interface may show a prize indicator, which may be a description of the prize (such as 20 spins on a prize wheel). The TapOff may be between a limited number of players (such as 5), may cost a certain number of in-game coins to play (such as 500) and may include milestone prizes (such as one or more coins, one or more raffle tickets, one or more boosts, and one or more spins on the prize wheel). When the TapOff game is selected the game system may wait until enough other players have selected the TapOff to begin a game, and may then send a notification to the players that the game has begun. During the waiting time the defined tapping area may display the word "Wait" indicating the game is waiting for other players. The user avatars and player names may be visible during the game. Boosts, described later, may be used during the TapOff. In some cases a TapOff game will end if no user has tapped within a certain amount of time (such as a 2 minute time frame). In other cases any individual player may be ejected from a TapOff game if he/she does not tap within a certain amount of time (such as a 2 minute time frame). In implementations each TapOff has a winning tap number of 200 taps and milestone tap numbers each 25 taps or each 20 taps.

Referring back to FIGS. 2-3, a boost indicator 24 is visible. A player may tap the boost indicator to bring up a player interface 148 shown in FIG. 11. Player interface 148 shows a list of boosts 142 purchasable using in-game coins for a specified cost 144. Next to each boost logo is also a count 146 indicating how many of that boost the player already has available to use. Upon tapping the cost 144 next to a boost the player may purchase a boost, and upon tapping the logo or description of the boost the player may activate an already owned boost. Player interface 148 includes an "X" which the user may tap to return to the previous screen.

Upon tapping on a cost icon a new screen will appear with a larger image of the boost icon describing the boost and listing the price, and asking the user to confirm the purchase. The user may tap a "GET" button to complete the purchase or may tap an "X" to return to the previous screen. Upon selecting a boost icon or description from the player interface 148, if the user does not already own one of that type of boost the same purchase window as described above will appear, whereas if the user already owns at least one of that type of boost a new window will appear with a larger image of the boost icon describing the boost and asking the player to confirm activation of the boost with an ACTIVATE button. The user may then tap this ACTIVATE button to activate the boost.

In implementations a boost is activated only for a single prize, and a player may activate several boosts at a time, each on a different prize, but may only activate one boost at a time per prize. Upon activating a boost for a played prize, the boost indicator 24 changes from the lightning logo to the icon associated with the particular boost, and the circle in which the icon is displayed includes a decreasing "pie" image displayed behind the boost logo, which is a timer indicating the amount of time left for the boost on the played prize. The timer thus appears as a pie with a decreasing pie size (which is implemented using two colors, one for the pie and another for the space left behind as the pie decreases), and when the timer runs out the logo changes back to the lightning bolt logo, indicating that no boost is active on the played prize.

Figure 9:
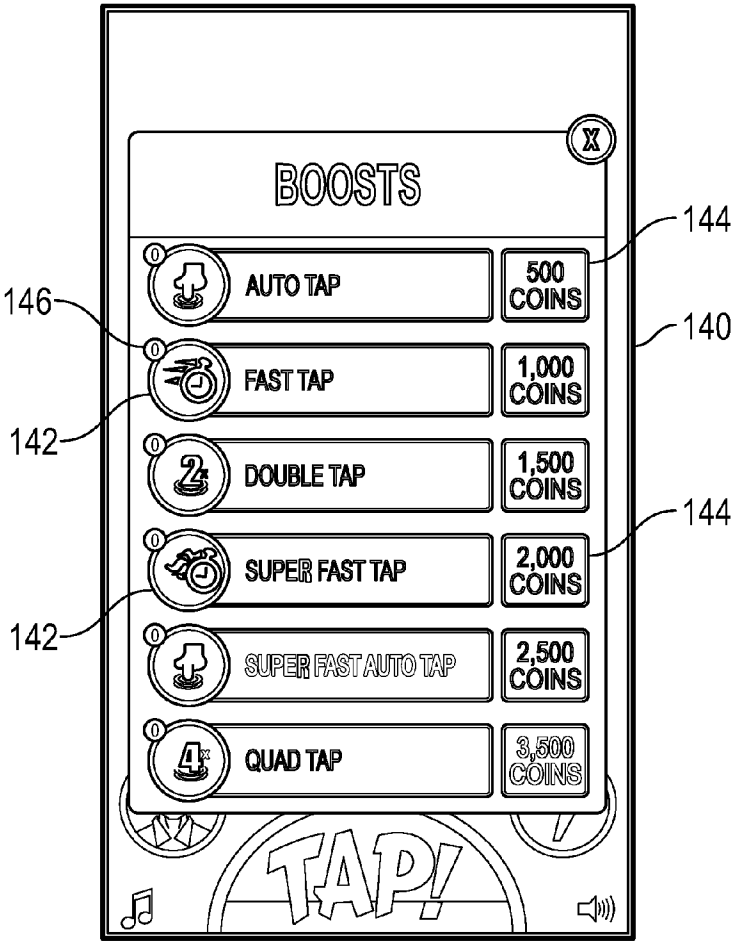
FIG. 9 is a seventh player interface of the game of FIG. 2.

A number of boosts are shown in FIG. 9. The first is an "Auto Tap" boost. During normal game play a player taps the tap button and then a tap waiting time indicator 66 appears (shown in FIG. 3). In the implementation shown the tap waiting time indicator is a different color "filling up" the defined tapping area, and when the defined tapping area is "filled in" again another tap may be executed. While the tapping area is being "filled up" there is a default wait time between taps. In the implementations shown in the drawings the default wait time is, or is about, five seconds. During the default wait time, if a player taps the defined tapping area, the player device does not send a tap signal to the server. Also, at any time, if the user taps outside of the defined tapping area, the player device does not send a tap signal to the server. Only a tap within the defined tapping area, which is not executed during a default wait time, results in the player device sending a tap signal to the server.

The first boost shown in FIG. 9 is an "Auto Tap" boost, as indicated. Normally a user must manually tap the defined tap area after the default wait time is expired in order to send another tap signal to the server and receive, accordingly, a tap number signal to display the assigned tap number. When the Auto Tap boost is activated, it automatically executes a tap (and accordingly sends a tap signal to the server) every 5 seconds for 2 minutes. Accordingly, during those 2 minutes the player does not need to manually execute a tap in order to send a tap signal to the server and receive a tap number signal to display the assigned tap number.

The second boost shown is a Fast Tap boost. This boost reduces the default wait time between taps from 5 seconds to 3 seconds for a three minute period. The third boost shown is a Double Tap boost. This boost executes two taps at once for a three minute period. This may be accomplished in a number of ways. During activation of the boost, for example, for each tap executed by a player the player device may send two tap signals to the server and be, accordingly, assigned two assigned tap numbers, and receive two tap number signals and display, in sequence, the two assigned tap numbers. Another way to implement this is to modify the tap signal so that it indicates information that two tap numbers should be assigned to the executed tap so that only a single modified tap signal is sent to the server and the server, in response, assigns two tap numbers, associates the two tap numbers with the sending user and/or sending device, and sends a tap number signal which only includes the greater of the two tap numbers to display the latest assigned tap number (unless the lesser of the two assigned tap numbers is the winning tap number). In some implementations the server may assign a plurality of consecutive tap numbers (consecutive assigned tap numbers) for each double tap, though in other implementations in which two tap signals are sent the server may assign a tap number to each but they may not be consecutive if a tap signal from another user/device is received in between the two tap signals from the double tap.

The fourth boost shown is a Super Fast Tap boost. This boost reduces the wait time between taps to 2 seconds for a three minute period. The fifth boost shown is a Super Fast Auto Tap. This boost automatically taps every 2 seconds for 2 minutes. The sixth boost shown is a Quad Tap. This boost uses four taps at once for 3 minutes and is similar to the Double Tap boost described above, except using four taps instead of two. As with the double tap, the server may assign consecutively numbered taps or, if the Quad Tap sends four tap signals, may assign tap numbers according to time received at the server or time sent by the sending device, in which case it may be possible that the assigned tap numbers from the Quad Tap are not consecutive.

In general, tap numbers may be assigned by the server according to time received by the server and/or the time sent by the sending device. By non-limiting example, in implementations each tap signal may include a time stamp from the sending device, and if a game system uses time sent to assign tap numbers then tap numbers will be assigned according to the time stamp order. Ties may be broken by time received at the server. Ties may alternatively be canceled and/or an error signal may be returned to the devices which may then send new tap signals in response in order to break the tie. In another implementation tap signals are assigned tap numbers according to time received by the server, and ties may be broken by time sent using time stamps from the sending devices, or ties may be canceled out and/or error signals sent to the sending devices to resend tap signals as indicated above to break the tie.

As described previously, each activated boost is prize specific, and accordingly a player may activate an Auto Tap on one prize, may scroll to another prize and active a Super Fast Auto Tap, may scroll to another prize and activate a Fast Tap, and may remain on the third prize tapping on it manually while the other two played prizes are being tapped automatically by the boosts. Any number of boosts of any type may be activated on any prize though, as indicated above, in implementations boosts may not be combined or, in other words, only one boost may be activated at a time on each played prize—attempting to activate a second boost on a prize that already has an active boost will result in a window which notifies the player that the selected boost will replace the active boost, which the player may choose to select or not.

Referring again to FIGS. 2-3, a music indicator 28 is shown. This may be tapped to toggle game music on and off. A sound effects indicator 30 is also shown. This may be tapped to toggle game sound effects on and off. Each tap properly executed within the defined tapping area outside of the wait time may initiate a sound effect which may be audible when the game sound effects are turned on, and a number of other sound effects may be initiated when a user taps or selects any other item, such as the boost indicator, though some items may be selected or tapped without a sound effect playing.

Figure 5:
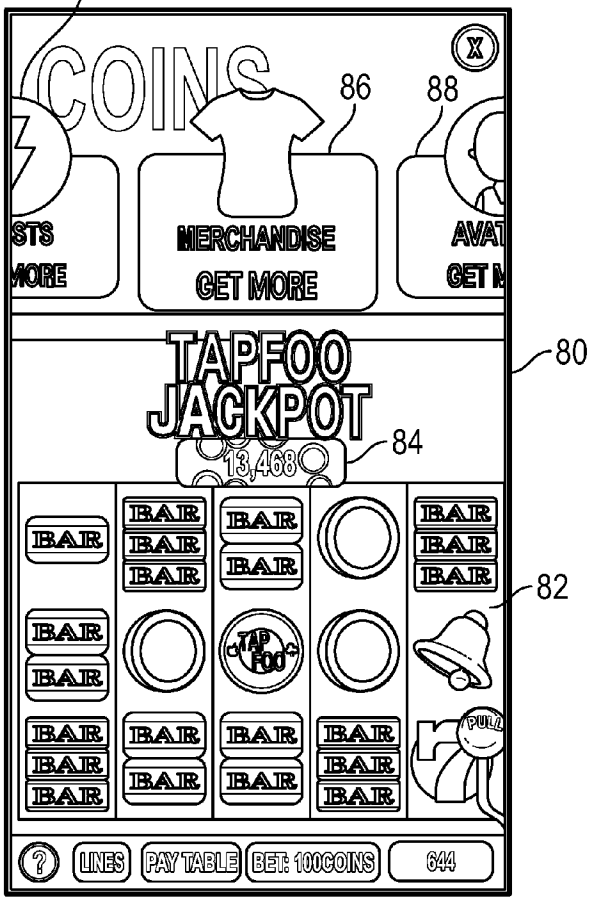
FIG. 5 is a third player interface of the game of FIG. 2.

FIGS. 2-3 also show a coin indicator 44 which indicates the number of coins the player has. A player may tap on the coin indicator to display the player interface 80 shown in FIG. 5. This interface includes a slot game 82 on which the user may bet coins and play a slot machine to win more coins. The number of coins the player has is displayed on the bottom left and, above this, a slot lever is illustrated which a player may tap to place the bet and start the slot machine scrolling. The bottom left shows a question mark icon which may be selected to bring up a description of various items. A Lines button may be pressed to display the pay lines. The Pay Table button may be pressed to show the amounts paid for winning combinations. The Bet button may be tapped to switch the bet between 100, 200, and 300 coins. A jackpot indicator 84 is shown, and any user achieving five TapFoo logos (which are wild) on any pay line wins the jackpot. The jackpot may simply be growing over time by a certain number of coins per unit time.

A merchandise link 86 is shown which a user may tap to bring up a merchandise window from which items may be purchased with in-game coins, such as t-shirts and other clothing items including logos of the operator and/or sponsors/funders, etc. An avatar link 88 is shown which, when tapped, brings up the list of selectable avatars previously described. A boosts link 90 is also present which may be tapped to bring up the player interface 140 previously described. An "X" may be tapped to return to the previous interface.

Figure 6:
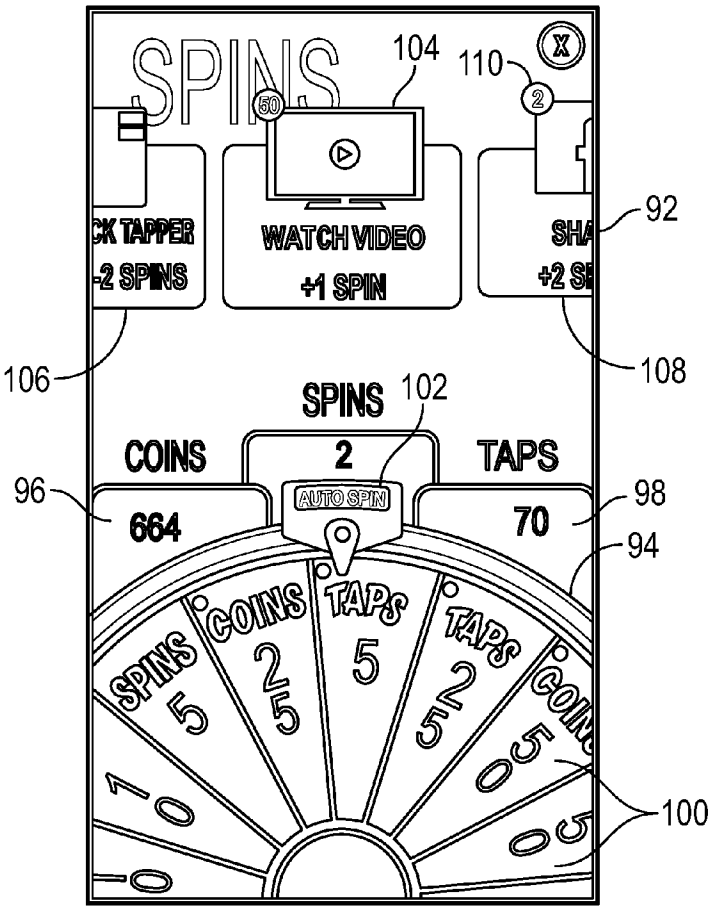
FIG. 6 is a fourth player interface of the game of FIG. 2.

FIGS. 2-3 also show a spin indicator 46 indicating how many spins the user has for the prize wheel. Below this is a bonus spin indicator 52 which indicates an amount of time left until a bonus spin is earned. In implementations a user may win a bonus spin every 90 minutes, though other increments could be used. A user may tap the spin indicator to bring up the player interface 92 shown in FIG. 6. This interface includes a prize wheel game 94 through which a user may win additional prizes. A coins indicator 96 is shown displaying the number of in-game coins the player has. A taps indicator 98 shows how many taps the player has. A prize 100 is shown on each "slice" of the prize wheel. The user may spin the wheel by performing a sideways swipe on the wheel. If the wheel does not make one complete turn a notification "Spin Faster" with curved arrows pointing to the left down and right down will be displayed. When the wheel is spun a full turn, once it lands on a prize a sound effect will be played and the number of taps or number of coins will be increased, respectively. Animations may be displayed for larger prizes, such as confetti or glitter or exploding coins for larger prizes of 1,000 coins and 50 taps. An auto spin indicator 102 may be tapped to automatically spin the wheel a number of times until the remaining spins are exhausted or until the user again taps the auto spin indicator to turn it off. A spins left indicator shows the number of spins remaining. The spins left indicator shown in FIG. 6 shows the number "2" directly above the auto spin indicator, indicating that there are 2 spins left.

Player interface 92 includes a video link 104 which a user may tap to watch a video advertisement to earn 1 spin on the prize wheel. A count 110 indicates how many advertisements are left for the player to watch in order to earn spins. The count shown on the video link indicates that there are 50 videos left to watch, meaning that the player could watch all 50 videos and earn 50 spins, or the user could watch less than 50 and earn that number of spins. The counter may reset each day, so that a user may watch up to 50 video advertisements each day in order to earn more spins. The video advertisement time/space may be purchased by third party advertisers and may include videos hosted by advertisers on separate advertiser servers, or on the server or database or operator computer, and may include links to purchase an advertised good or service, and so forth, with an "X" to allow the player to return to player interface 92. In some implementations a video advertisement may pause or may start over if a user leaves the advertisement screen during the advertisement.

There are additional, paid methods of advertising for a sponsor beyond providing prizes for players to win and beyond the paid video advertisements described above. These examples include, by non-limiting example, providing a brick game and providing a tile puzzle, as described below.

Figure 7:
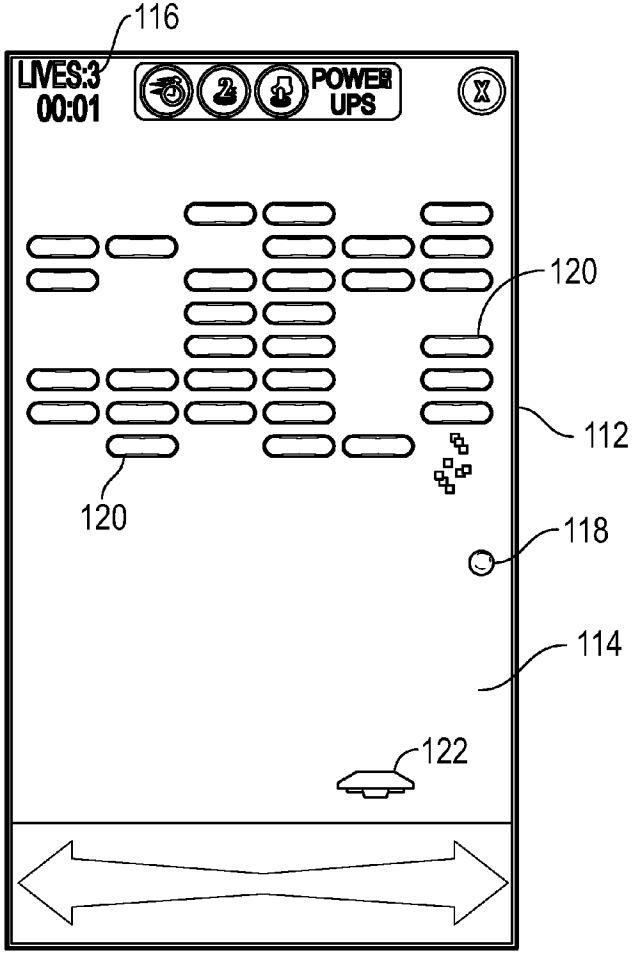
FIG. 7 is a fifth player interface of the game of FIG. 2.

Player interface 92 includes a brick game link 106 which also includes a counter indicating the number of brick games that may be played each day for free. In implementations the player may play 3 brick games for free each day, and each brick game thereafter costs 250 coins. Upon tapping the brick game link a new window appears indicating that the player may play with 3 lives for 1 spin or with 1 life for 2 spins. Upon selecting the game mode a player interface 112 as shown in FIG. 7 appears which displays a brick tapper game 114. A "launch ball" button is originally present which a user may tap to begin the game. A lives indicator 116 shows how many lives the player has left and underneath this a timer shows how much time has elapsed. An "X" is present allowing the user to exit the game mid-play if desired, though this will forfeit any prize that could be won by completing the game and a warning will appear confirming whether the user wants to quit the game (though upon quitting the game the user may win a prize of 100 coins). A "like us on Facebook" link may appear at the end of the game whether the player wins or not which, if selected, will link to the user's social media profile marketed under the mark FACEBOOK by Facebook, Inc. of Menlo Park, Calif., and/or to a social media profile or page of the operator to allow the player to "like" the social media profile/page. A "next" button will also appear which, if tapped by the user, will bring up a list of the daily leaders for the game mode selected (1 life or 3 lives), including avatar images, user names, and times to win the game. In implementations leaders at the end of the day (such as the top three or top ten) will receive tickets to a weekly raffle (described hereafter).

During the brick game bricks 120 may be hit by bouncing a ball 118 off a paddle 122 which may be moved sideways by a user swiping a finger sideways anywhere on player interface 112 (though the area at the bottom with left and right arrows is convenient so as to not block the user's view of the bricks). Bricks may change color when hit, and when hit a certain number of times (such as three) may explode or disintegrate. Some exploding bricks may drop a rotating icon that if caught by the paddle may implement a bonus, such as a double ball bonus (which adds two more balls), an increased speed bonus which increases the speed of the ball, and an auto-fire bonus which causes the paddle to auto-fire shots at the bricks which also serve to change the color of the bricks and to disintegrate them. Bonuses may be combined, so that a user may have the auto-fire function, increased ball speed, and one or more additional balls (for instance if a user gets two double ball bonuses then there will be five balls at once.

A bonus indicator is present at the top of the game screen and shows which bonuses are active (increased speed, multiple balls, or auto-fire). The increased speed and auto-fire indicators light up and have timers (similar to that described for the boost indicator 24) since they run out after a certain amount of time, while the double ball indicator lights up when there is more than one ball present, and stays lit up until the player loses all but one ball.

If the user eliminates all bricks before the lives are expended, a prize window appears indicating that the user has won 1 or 2 spins, depending on the game mode, and including the same "Like us on Facebook" and "Next" buttons as previously described, as well as the daily leaders list as previously described. If the user does not eliminate all bricks before the lives are expended the user is given 100 coins.

Player interface 92 includes a social media link 108 which a user may tap to share a prize on a social media site, such as FACEBOOK, to earn 2 spins. When a user selects the social media link a sideways scrollable list of the prizes offered by sponsors or the operator are shown, and the user may select one to post, on his/her FACEBOOK profile, indicating that he/she is playing the game for that prize. A count 110 is present on the social media link and indicates that the user may share two prizes per day for a total of 4 spins (2 spins each). If a user attempts to share the same prize more than once in one day a message will appear indicating that the user has already shared that prize today. Naturally, the count 110 for any of the links may be modified as desired by the operator.

As described above, the brick game may be used as a sole paid advertising space for an advertiser or additional advertising space for a sponsor of a prize. The background of the brick game, for instance, could include an image of an advertisement.

Other links are visible on player interface 92 though they are not shown in the drawings, including a $0.99 Buy Spins link to buy 20 spins and a $4.99 Buy Spins link to buy 150 spins. Upon tapping either of these links a pay account window will appear which will allow the user to purchase the spins through a payment account, such as an account operated under the name GOOGLE WALLET by Google Inc. of Mountain View, Calif. Other pay accounts could be linked to the user account to make the payment, or the payment could be made by credit card.

A Play Puzzle link is also shown on player interface 92, though it is not visible in any of the drawings. Upon selecting this the user is presented with an option between a 3×3 puzzle for 1 spin and a 4×4 puzzle for 2 spins. The user, upon selecting the game mode, then is presented with an image, a portion of which is sectioned into square tiles which are rearranged to form a 4×4 or a 3×3 puzzle. The user then has 2 minutes to rearrange the tiles to their correct positions to earn 1 or 2 spins, accordingly. If the user does not finish in time, the user may still complete the puzzle to earn 100 coins, or the user may "X" out of the game to forfeit any winnings (the user will be presented with a confirmation page before exiting). An "eyeglass" icon may be pressed during the game to show what the finished picture should look like, and each tile may have a small number in its corner to help the user know the order in which to place the tiles. The player device may vibrate upon selecting the game mode and may vibrate again after a visible "Ready" "Set" "Go" are presented on the screen to begin the game. During the first two minutes a timer is presented counting up to two minutes indicating to the player how much time is left to complete the game for 1 or 2 spins, and after the 2 minutes are elapsed the wording appears "Finish to earn 100 coins" and the timer continues counting.

At the end of the game the same "Like us on Facebook" and "Next" buttons will be present as described previously for the brick tapper game. If the player did not complete the puzzle in time then the player will win 100 coins, and if the player completed the puzzle in time the player will win 1 or 2 spins, respectively. Upon selecting the Next button the player will be presented with the daily leaders (lowest times) to complete the puzzle (4×4 or 3×3 according to which was selected by the player), along with avatar images, user names, and puzzle completion time. Leaders at the end of the day (such as top three or top ten) will receive tickets to a weekly raffle which will be described hereafter.

A count 110 is also present on the Play Puzzle link indicating that 3 puzzles may be played for free each day, and after these are expended the user may play a puzzle for 250 coins. As with the other counts 110 described herein, this count may be modified by an operator as desired.

The puzzles described above may be used as the sole paid advertising space for an advertiser or additional advertising space for a sponsor of a prize. The puzzle image, for instance, could include an image of an advertisement.

If a player attempts to leave player interface 92 during a spin (or during auto spinning) the user will be presented with a warning that the spinning is taking place. If a user attempts to spin the wheel when he/she has zero spins left the user will be presented with a notification that he/she has no spins left but that he/she can earn or purchase more using one of the methods described above.

In implementations in which a tapping game, implemented as described above, includes more than one prize, each tap signal may further include an indicator of the played prize, which may be associated with the assigned tap number and with the sending user and/or sending device through the database.

When a played prize has been won by a player, each other player that played for that prize (or any subset thereof that were close in time or number of taps to the winning tap) may receive a notification (which may be in the form of a "So Close" screen) indicating how close they were in terms of time and/or taps to the winning tap, and may be notified which user won the prize, and may be awarded a prize for coming close (such as one or more raffle tickets, one or more coins, one or more taps, one or more gift cards, one or more spins on the prize wheel, etc.).

Although the tapping game is played with "taps" in the defined tapping areas, other icons, elements, etc., that are selected during game play could be modified to be accessed with swipes, double taps, rotations, or other touch inputs, instead of or in addition to a single tap.

Referring back to FIGS. 2-3, a taps left indicator 48 is shown indicating how many taps the user/player has left to use. When the number of taps gets low (such as 10 or 5) the number may turn red and begin to flash to notify the player that he/she is nearly out of taps, and when the player has zero taps and attempts to execute a tap a screen may appear notifying the user that he/she is out of taps but may earn more using the prize wheel.

If a player taps on the taps left indicator a Taps Interface appears which shows the player's avatar and user name and "Player since_" indicating the date the player began playing the tapping game. The avatar may be clicked on to bring up the list of selectable avatars previously described. The Taps Interface further includes an "X" to exit the interface, a listing showing the total number of taps available, total number of taps used this week by the player, total number of taps used overall by the player, total number of taps used today by the player, total taps by all players combined overall, and total number of winners. The Taps Interface further includes a link to player interface 92 (the prize wheel) with a picture of the prize wheel and the wording "Want more Taps? Spin to Win Some."

FIGS. 2-3 further show a raffle indicator 50. This appears as an icon of a ticket with a countdown to the next drawing (it shows 4 days in FIGS. 2-3). A user in general may earn 1 ticket for each 20 taps. Each time a user executes a tap the ticket may be "filled in" (from left to right) with a color and each time the ticket "fills up" due to 20 taps the ticket may shake and become empty again, indicating that another ticket has been earned.

Figure 8:
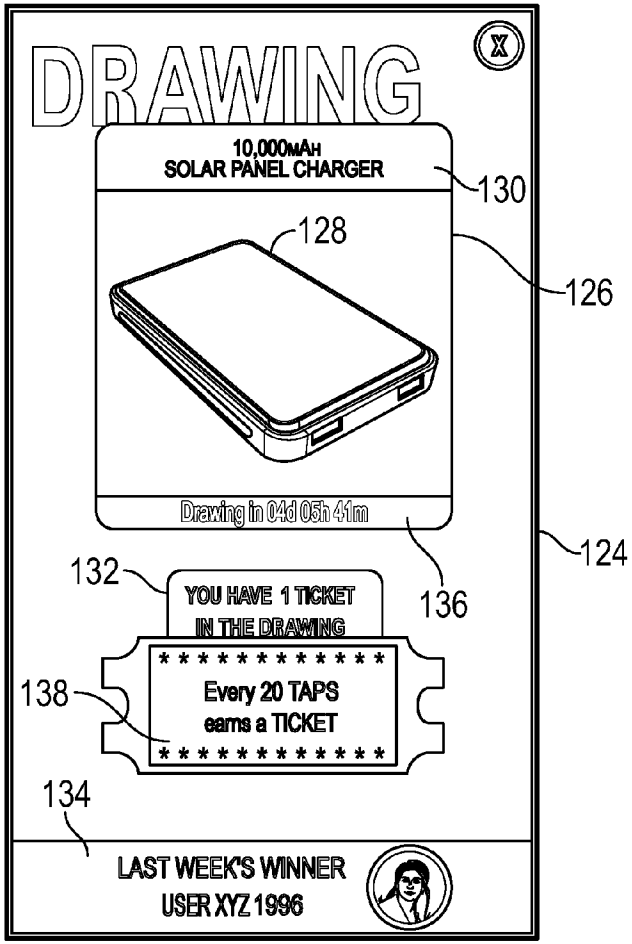
FIG. 8 is a sixth player interface of the game of FIG. 2.

A player may tap the raffle indicator to bring up the player interface 124 shown in FIG. 8. This interface includes a raffle prize indicator 126 which may include an image 128 of the prize and/or a written description 130 of the raffled prize. A ticket amount indicator 132 indicates how many tickets the player has earned to be entered in the raffle. A last winner indicator 134 indicates the last winner of the raffle, including showing that user's avatar and user name. A countdown 136 is shown which indicates how long until the raffle drawing. A description 138 is also given which indicates how tickets are earned (such as "Every 20 Taps earns a Ticket." A player may tap on the raffle prize indicator 126 to bring up the Prize/Sponsor Interface previously described. The raffled prizes may be offered by sponsors/funders or by the operator or by advertisers. The Prize/Sponsor Interface may include sponsor contact information and/or a link to the sponsor/funder website.

The raffle may be completely automated using the server and/or operator computer such that each raffle ticket is simply a "digital" ticket and when the time elapses for carrying out the raffle the server or operator computer randomly selects one of the digital tickets and sends a notification signal to the winning user and/or winning device.

In any game in which a played prize is offered by a sponsor/funder the server may associate, in the database, a sponsor indicator with the prize and/or the prize identifier. The sponsor indicator may include a name of the sponsor, a code representative of the sponsor, or the like.

Referring to FIG. 2, in implementations a bonus indicator 64 is present on one or more of the player interfaces. The bonus indicator in FIG. 2 includes an animation of lightning and includes sound effects sounding like the buzzing of electricity. The bonus indicator indicates that additional prizes are earned for each tap executed on the played prize. The prizes may include, for example, from 1 to 50 coins, from 1 to 3 raffle tickets, one boost, 1-2 spins on the prize wheel, and so forth. The lightning animation may light up more when a tap is executed in the defined tapping area.

A bonus prize graphic 68 may also be present after each tap when the bonus indicator is present. The example shown in FIG. 3 is a +5 and a floating, rotating coin to indicate that the player has earned 5 coins with the last tap. Other animations include a floating, spinning raffle ticket, a floating, spinning prize wheel, a floating, spinning boost icon, and the like. The bonus indicator may be used, by non-limiting example, as a way to incentivize players to tap for prizes which are receiving less attention. The bonus indicator could be synced across all player devices (for instance all players receive a bonus for tapping on a certain prize during a specified time frame) or individual for each player (for instance a first player having the bonus activated during one time frame on a prize and a second player having the bonus activated on that same prize during a different time frame, or on a different prize during the same or a different time frame). In any case the bonus is temporary and lasts for a predetermined amount of time.

Many of the player interfaces shown in the drawings include a background graphics area 70 as shown in FIG. 3 which may be filled with colors, designs, images, wording, and the like according to the desire or design of the operator and/or sponsors/funders and/or advertisers. In implementations the background image may move on the screen behind the prize display area as a user moves his/her playing device, thus using the movement sensors built into the playing device (such as smart phone or tablet), such as moving the background left or right as the user moves the device right or left (or vice versa), moving the background image up or down as the user moves the device down or up (or vice versa), and so forth. Additionally, the background image may "bounce back" to its original configuration after the initial movement. These backgrounds can be supplied by the operator or provided by a sponsor/funder of the prize and may be used as an additional method of advertising/branding for the sponsor/funder.

The tapping game provides an advertising platform for advertisers and sponsors. One way this is done is through providing sponsored prizes, whereby the prizes are themselves used to advertise a product or service. Another way is through paid advertising, purchased by advertisers, which paid advertising may be viewed by players in order to continue playing the game and earning in-app currency. For example, a player watching more video advertisements, or playing more brick tapping games or solving more tile puzzles with background advertising images, may as a result obtain more spins of the prize wheel, more taps, and more coins, and with the coins may purchase more boosts. Thus, by increasing his/her boosts and taps, a player may be enabled to continue playing the game and earn in-app currency. In this way, players are incentivized to view advertising materials, and the tapping game thus effectively comprises an advertising platform for sponsors and advertisers.

In some implementations the operator computer and sponsor/funder computer may be included in the same device/machine and or may be the same computer/device.

In places where the description above refers to particular implementations of game systems and related methods and implementing components, sub-components, methods and sub-methods, it should be readily apparent that a number of modifications may be made without departing from the spirit thereof and that these implementations, implementing components, sub-components, methods and sub-methods may be applied to other game systems and related methods.

What is claimed is:

1. A game system, comprising:

a server operatively coupled with a database;

an operator computer operatively coupled with the server, the operator computer comprising a display displaying one or more operator user interfaces, the one or more operator user interfaces configured to receive one or more inputs from an operator to associate, through the database, a prize identifier and a winning tap number for a prize;

a plurality of mobile computing devices (player devices) operatively coupled with the server through a telecommunication network, each player device displaying, on a touchscreen display, a player user interface (player interface) comprising the prize identifier, the winning tap number, and a defined tapping area;

wherein each player device is configured to, in response to receiving a tap within the defined tapping area, communicate a tap signal to the server through the telecommunication network, the tap signal comprising one of an identifier of a user (sending user) and an identifier of the player device sending the tap signal (sending device);

wherein the server is configured to, in response to receiving the tap signal, generate an assigned tap number for the tap signal and associate, in the database, the assigned tap number with one of the sending user and the sending device;

wherein the server is configured to determine whether the assigned tap number matches the winning tap number;

wherein the server is configured to, in response to determining that the assigned tap number matches the winning tap number, send a winning signal to the sending device through the telecommunication network, and;

wherein the sending device is configured to display a winning indicator on the player interface in response to receiving the winning signal, the winning indicator indicating that the sending user has won the prize.

2. The game system of claim 1, wherein the defined tapping area of each player device comprises a default wait time of over two seconds between taps, wherein each player device is configured to, in response to receiving a tap within the defined tapping area during the default wait time, not communicate a tap signal to the server.

3. The game system of claim 2, wherein the player interface further comprises a boost indicator, the boost indicator configured to, in response to receiving a touch input from a user, one of shorten the default wait time, increase a quantity of tap signals sent to the server in response to receiving a tap within the defined tapping area, modify tap signals for a predetermined amount of time such that the server generates a plurality of consecutive assigned tap numbers for each modified tap signal, and automatically send a plurality of tap signals to the server without receiving a tap within the defined tapping area.

4. The game system of claim 1, wherein the server generates the assigned tap number based upon one of a time that the tap signal was received at the server and a time that the tap signal was sent from the sending device.

5. The game system of claim 1, wherein the one or more operator user interfaces are further configured to receive one or more inputs from the operator to define a plurality of milestone tap numbers lower than the winning tap number, wherein the server is configured to, when the assigned tap number matches one of the milestone tap numbers, send a milestone signal to the sending device through the telecommunication network, and wherein the sending device is configured to display a milestone won indicator on the player interface in response to receiving the milestone signal, the milestone won indicator indicating that the sending user has won a milestone prize.

6. The game system of claim 1, wherein the prize identifier comprises one of an image of the prize and a written description of the prize.

7. The game system of claim 1, wherein the server is configured to send a tap number signal to the sending device through the telecommunication network in response to generating the assigned tap number, and wherein the sending device is configured to display the assigned tap number on the player interface in response to receiving the tap number signal.

8. A game system, comprising:

a server operatively coupled with a database;

an operator computer operatively coupled with the server, the operator computer comprising a display displaying one or more operator user interfaces, the one or more operator user interfaces configured to receive one or more inputs from an operator to associate, through the database, a prize identifier and a winning tap number for each of a plurality of prizes;

a plurality of mobile computing devices (player devices) operatively coupled with the server through a telecommunication network, each player device displaying, on a touchscreen display, a plurality of player user interfaces (player interfaces), wherein each player device is configured to, in response to receiving a touch input from a user, switch between the plurality of player interfaces;

wherein each player interface comprises a defined tapping area, the prize identifier associated with one of the prizes, and the winning tap number associated with that prize;

wherein each player device is configured to, in response to receiving a tap within the defined tapping area of one of the player interfaces associated with one of the prizes (played prize), communicate a tap signal to the server through the telecommunication network, the tap signal comprising an indicator of the played prize and further comprising one of an identifier of a user (sending user) and an identifier of the player device sending the tap signal (sending device);

wherein the server is configured to, in response to receiving the tap signal, generate an assigned tap number for the tap signal and associate, in the database, the assigned tap number with the played prize and with one of the sending user and the sending device;

wherein the server is configured to determine whether the assigned tap number matches the winning tap number for the played prize;

wherein the server is configured to, in response to determining that the assigned tap number matches the winning tap number for the played prize, send a winning signal to the sending device, and;

wherein the sending device is configured to display a winning indicator on one of the player interfaces in response to receiving the winning signal, the winning indicator indicating that the sending user has won the played prize.

9. The game system of claim 8, wherein the defined tapping area of each player interface comprises a default wait time of over two seconds between taps, wherein each player device is configured to, in response to receiving a tap within the defined tapping area during the default wait time, not communicate a tap signal to the server.

10. The game system of claim 9, wherein each player interface further comprises a boost indicator, the boost indicator configured to, in response to receiving a touch input from a user, one of shorten the default wait time, increase a quantity of tap signals sent to the server in response to receiving a tap within the defined tapping area, modify tap signals for a predetermined amount of time such that the server generates a plurality of consecutive assigned tap numbers for each modified tap signal, and automatically send a plurality of tap signals to the server without receiving a tap within the defined tapping area.

11. The game system of claim 8, wherein the server generates the assigned tap number based upon one of a time that the tap signal was received at the server and a time that the tap signal was sent from the sending device.

12. The game system of claim 8, wherein the one or more operator user interfaces are further configured to receive one or more inputs from the operator to define a plurality of milestone tap numbers lower than the winning tap number for each prize, wherein the server is configured to, when the assigned tap number matches one of the milestone tap numbers for the played prize, send a milestone signal to the sending device through the telecommunication network, and wherein the sending device is configured to display a milestone won indicator on one of the player interfaces in response to receiving the milestone signal, the milestone won indicator indicating that the sending user has won a milestone prize.

13. The game system of claim 8, wherein the server is configured to send a tap number signal to the sending device through the telecommunication network in response to generating the assigned tap number, and wherein the sending device is configured to display the assigned tap number on one of the player interfaces in response to receiving the tap number signal.

14. A method of playing a tapping game, comprising:

operatively coupling a server with a database;

operatively coupling an operator computer with the server;

receiving at the operator computer, using one or more operator user interfaces displayed on a display of the operator computer, one or more inputs from an operator to associate, through the database, a prize identifier and a winning tap number for a prize;

operatively coupling a plurality of mobile computing devices (player devices) with the server through a telecommunication network;

displaying, on each player device, on a touchscreen display, a player user interface (player interface) comprising the prize identifier, the winning tap number, and a defined tapping area;

receiving, at each player device, a tap within the defined tapping area of the player interface;

communicating a tap signal to the server through the telecommunication network from each player device, each tap signal comprising one of an identifier of a user (sending user) and an identifier of the player device sending the tap signal (sending device);

generating, through the server, in response to receiving each tap signal, an assigned tap number;

associating, through the database, the assigned tap number with one of the sending user and the sending device;

determining, using one of the server and the operator computer, whether the assigned tap number matches the winning tap number;

in response to determining that the assigned tap number matches the winning tap number, sending, using one of the server and the operator computer, through the telecommunication network, a winning signal to the sending device, and;

displaying, on the player interface of the sending device, in response to receiving the winning signal, a winning indicator, the winning indicator indicating that the sending user has won the prize.

15. The method of claim 14, wherein the defined tapping area of each player device comprises a default wait time of over two seconds between taps, wherein each player device, in response to receiving a tap within the defined tapping area during the default wait time, does not communicate a tap signal to the server.

16. The method of claim 15, wherein the player interface further comprises a boost indicator, wherein the boost indicator, in response to receiving a touch input from a user, one of shortens the default wait time, increases a quantity of tap signals sent to the server in response to receiving a tap within the defined tapping area, modifies tap signals for a predetermined amount of time such that the server generates a plurality of consecutive assigned tap numbers for each modified tap signal, and automatically sends a plurality of tap signals to the server without receiving a tap within the defined tapping area.

17. The method of claim 14, further comprising using the player interface as an advertising platform by providing the prize identifier, an identifier for a sponsor of the prize, and access to paid advertisements viewable by players through the player interface to enable the players to continue tapping for the prize.

18. The method of claim 14, further comprising receiving one or more inputs from the operator through the one or more operator user interfaces to define a plurality of milestone tap numbers lower than the winning tap number, wherein the server, in response to determining that the assigned tap number matches one of the milestone tap numbers, sends a milestone signal to the sending device through the telecommunication network, and wherein the sending device displays a milestone won indicator on the player interface in response to receiving the milestone signal, the milestone won indicator indicating that the sending user has won a milestone prize.

19. The method of claim 14, wherein the winning tap number is displayed on the player interface of each player device only after a tap has been received within the defined tapping area of that player interface.

20. The method of claim 14, further comprising sending, using one of the server and the operator computer, in response to generating the assigned tap number, a tap number signal to the sending device through the telecommunication network, and displaying the assigned tap number on the player interface of the sending device in response to the sending device receiving the tap number signal.

* * * * *